United States Patent [19]

Todd

[11] 4,453,445

[45] Jun. 12, 1984

[54] SAXOPHONE VALVE KEY

[76] Inventor: John H. Todd, 486 Indiana Ave., Mansfield, Ohio 44905

[21] Appl. No.: 422,546

[22] Filed: Sep. 24, 1982

[51] Int. Cl.[3] ..... G10D 7/08

[52] U.S. Cl. ..... 84/385R

[58] Field of Search ..... 84/385

[56] References Cited

U.S. PATENT DOCUMENTS

| | | | |
|---|---|---|---|
| 1,581,494 | 4/1926 | Stover | 84/385 |
| 1,610,207 | 12/1926 | Hilton | 84/385 |
| 1,632,008 | 6/1927 | Lemm | 84/385 |
| 1,828,389 | 10/1931 | Calvani | 84/385 |
| 1,873,184 | 8/1932 | Calvani | 84/385 |
| 2,033,774 | 3/1936 | Loomis | 84/385 |
| 2,055,382 | 9/1936 | Loomis | 84/385 |
| 2,090,011 | 8/1937 | Selmer | 84/385 |
| 2,151,337 | 3/1939 | Selmer | 84/385 |
| 2,555,980 | 6/1951 | Loney | 84/385 |
| 3,710,558 | 6/1955 | Lefevre-Selmer | 84/385 |
| 4,148,242 | 4/1979 | Woehr | 84/385 |

*Primary Examiner*—Donald A. Griffin

*Attorney, Agent, or Firm*—Pearne, Gordon, Sessions, McCoy, Granger & Tilberry

[57] ABSTRACT

A new right-hand, low register C-sharp key is provided for a saxophone, in addition to the conventional left-hand, low register C-sharp key. The saxophone may have the usual key shaft partially rotated by the conventional left-hand C-sharp key in order to open the low register C-sharp key on the saxophone. A new key is provided to be actuated by the little finger of the right-hand, which when actuated will open the same low register C-sharp valve, so that such valve may be actuated alternatively by either the right-hand or left-hand little finger. The foregoing abstract is merely a resume of one general application, is not a complete discussion of all principles of operation or applications, and is not to be construed as a limitation on the scope of the claimed subject matter.

14 Claims, 5 Drawing Figures

SAXOPHONE VALVE KEY

BACKGROUND OF THE INVENTION

In the history of the development of saxophones, extra valves were placed on the bell of the saxophone in order to play three extra half-notes below the notes possible to be played with valves only on the body of the saxophone. This meant that three extra keys were required in order to actuate these three extra valves, and it has been customary in recent years to place four keys grouped in a cluster each for actuation by the little finger of the left hand. These were for actuating valves to play the low register notes of G-sharp, C-sharp, B and B-flat. A number of prior art patents have recognized the difficulty of the facile manipulation of these keys, and the transition in actuation from one key to the other. U.S. Pat. No. 2,710,558, for example, was directed to this cluster of four keys, and changed the configuration of these keys somewhat in order to make it easier to have a transistion from C-sharp to B-flat. U.S. Pat. No. 1,828,389 changed the arrangement of a normally closed C-sharp and D-natural valve to ones which were normally open, and then provided a different keying arrangement so that the little finger of the right hand could close both valves with an independent finger-actuated means operable by the little finger of the left hand for separately closing the D-natural valve.

U.S. Pat. No. 2,555,980 provided a movable lug on the saxophone so that the G-sharp, C-sharp, B, and B-flat cluster of keys for the left-hand little finger could have two different modes of operation, as desired by the saxophone player.

U.S. Pat. No. 2,055,382 again discloses this cluster of four keys, and provides a G-sharp trill lever for rapid and repeated operation of the G-sharp valve.

U.S. Pat. No. 1,873,184 recognized the difficulty of obtaining a quick transistion from the C-sharp to the D-natural tone when a saxophone had a normally closed C-sharp valve and a normally open D-natural valve. The patentee's change was to make both the C-sharp and D-natural valves normally open, with the D-natural valve separately controlled from the usual C-sharp key by the left hand and both valves being simultaneously closed by the little finger of the right hand from the ordinary C-natural position.

U.S. Pat. No. 1,632,008 also addressed the problem of the cluster of G-sharp, C-sharp, B, and B-flat keys actuable by the little finger of the left hand, and attempted to solve the problem by providing only three keys instead of four to be actuated.

U.S. Pat. No. 4,148,242 was also concerned with this same cluster of four keys operable by the left-hand little finger, and provided an extra key operable by the thumb of the left hand in order to play the B-flat note in the lower register.

All of these prior patents recognized somewhat the difficulty of easy and rapid manipulation of these four separate keys, G-sharp, C-sharp, B, and B-flat, by the little finger of the left hand; however, none of the patents solved the problem of a rapid change of tone from C-sharp to B-flat or from C-sharp to B.

SUMMARY OF THE INVENTION

The problem to be solved, therefore, is how to construct a saxophone keying arrangement which is capable of easy and rapid manipulation between B and C-sharp or between B-flat and C-sharp in the lower register of a saxophone. This problem is solved by a saxophone having a body and a bell and a left-hand C-sharp key connected through a first linkage for actuating a low register C-sharp valve, comprising in combination a right-hand C-sharp key journaled for pivotal motions on said body, a second linkage connecting said right-hand C-sharp key and the low register C-sharp valve, and said low register C-sharp valve being actuable alternatively through said first or second linkage by actuation of said left or right-hand low register C-sharp keys, respectively.

The problem is further solved by a saxophone having a new key for playing the C-sharp note in the lower register with the right hand, said key being located adjacent the lower end of the body of the saxophone whereby the low register C-sharp valve can be played with either the little finger of the left hand or the little finger of the right hand.

The problem may further be solved by a saxophone having a body, a bell, a left-hand C-sharp key connected through a first linkage for actuating a low register C-sharp valve and a right-hand low register C-natural key, the improvement comprising an additional key mounted for movement on the body and a second linkage from said additional key to actuate both said low register C-sharp valve and the right-hand C-natural key.

Accordingly, it is an object of the present invention to provide a saxophone having a mechanism to make an easier transition between the playing of closely adjacent notes.

Another object of the invention is to provide a saxophone with a mechanism to play a B to C-sharp trill.

A further object of the invention is to provide a saxophone with a mechanism to enable the playing of a B-flat to C-sharp tremolo.

Other objects and a fuller understanding of the invention may be had by referring to the following description and claims, taken in conjunction with the accompanying drawings.

DESCRIPTION OF THE PREFERRED EMBODIMENT

Figure 1:
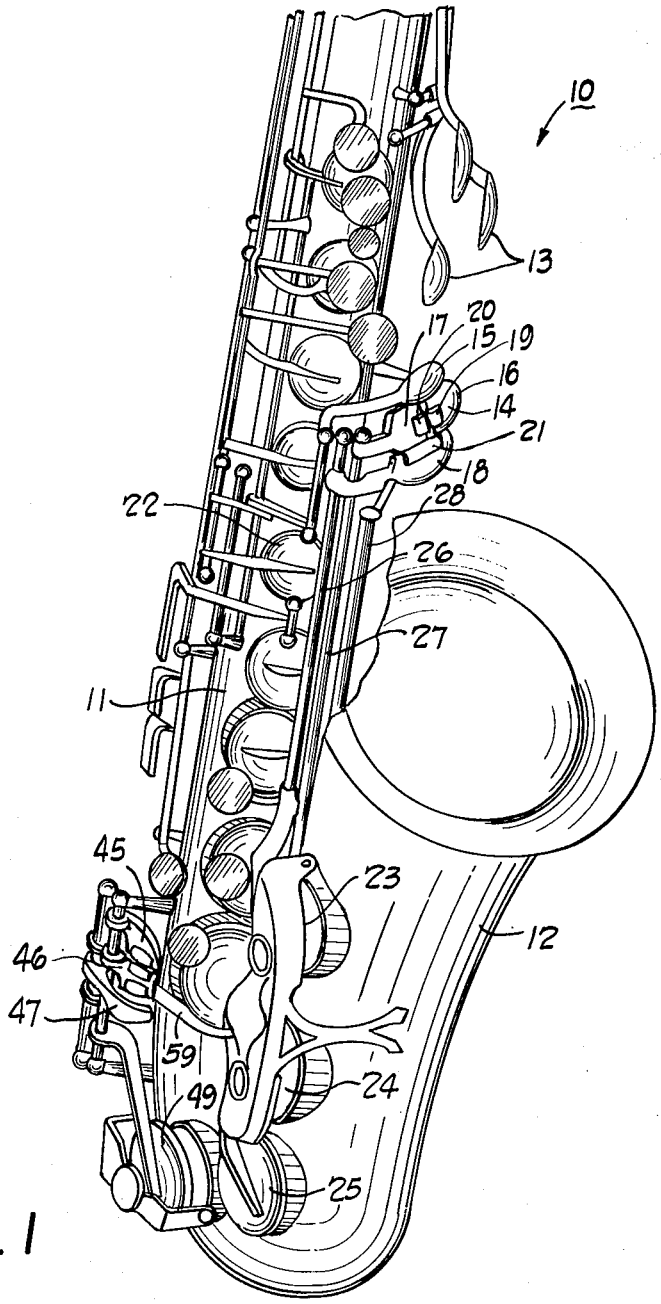
FIG. 1 is a perspective view of the lower part of a saxophone, and illustrating the new key of the present invention.
Figure 2:
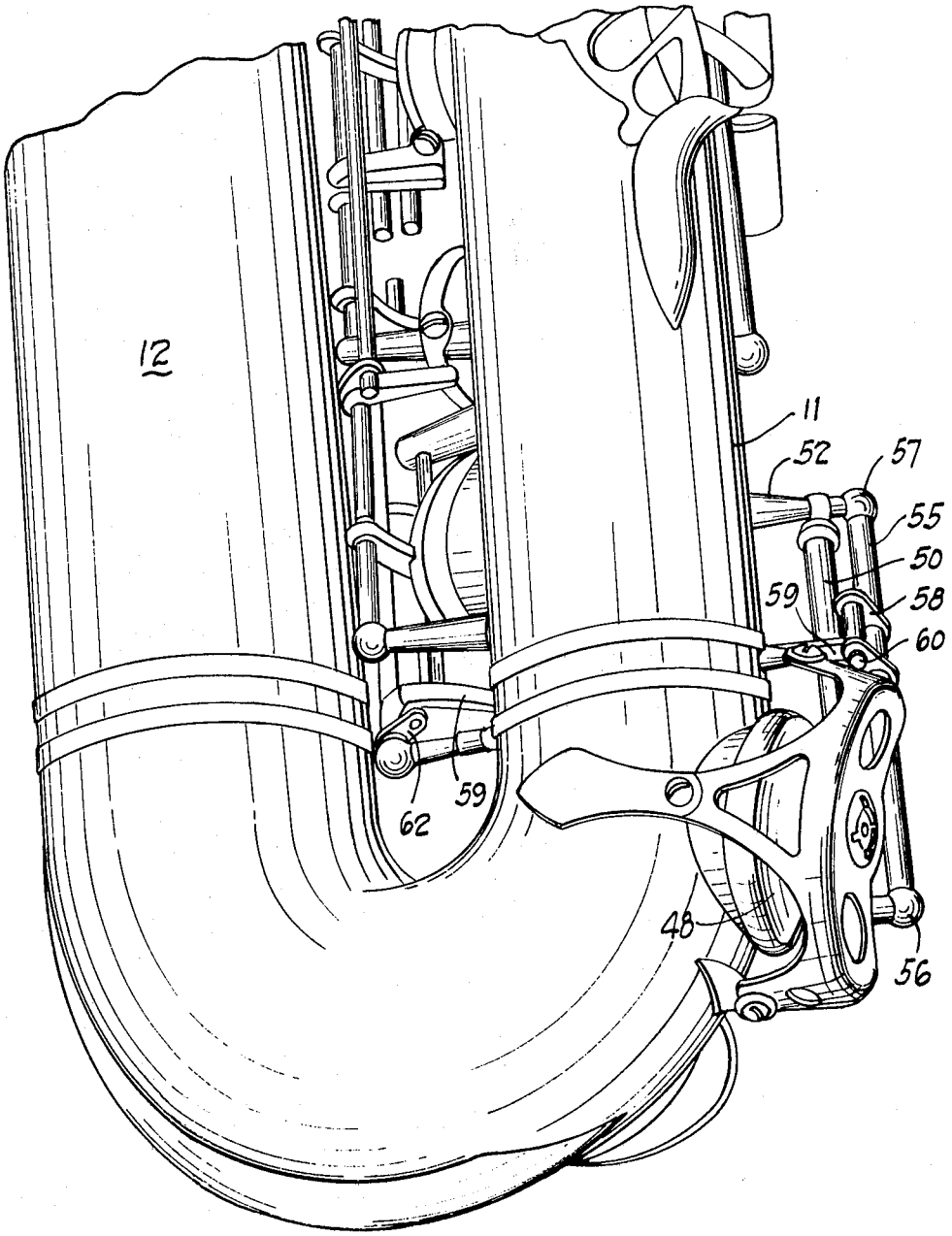
FIG. 2 is a perspective view of part of the left side of the saxophone incorporating the invention.

In the illustrated saxophone, well known and conventional parts have been omitted, and the description thereof has also been omitted in order not to obscure the novel construction of the present invention. This omitted structure may take any of many forms which will cooperate with the novel features of the invention to provide a practical saxophone.

The drawings illustrate a saxophone 10 having a body 11 and a bell 12. A number of keys 13 are illustrated to be played with the left hand, and a key cluster 14 is intended to be played by the little finger of the left hand. This cluster of keys includes four keys: a G-sharp key 15, a C-sharp key 16, a B-natural key 17, and a B-flat key 18. Optionally, the keys 16, 17, and 18 may be provided with rollers 19, 20, 21, respectively, to aid in the transition of fingering among the several keys. The G-sharp key 15 is connected through linkage to actuate the G-sharp valve 22 in a normal manner. The B-flat key 18 is connected through linkage to actuate a B-flat valve 23 in any one of several ways. The preferred embodiment is with the B-flat key 18 fixedly connected to a B-flat key shaft 26 which will arcuately rotate to close the B-flat valve 23 when the key 18 is depressed. The B-natural key 17 is connected through linkage to actuate the B-natural valve 24 in any one of several practical ways. In a preferred embodiment, this B-natural key 17 is secured to a B-natural key shaft 27 so that the B-natural valve 24 is closed when the key 17 is depressed. Also, according to usual practice, the B-natural key 17 has a projection 30 underlying the B-flat key 18 so that when the key 18 is depressed, both the B-flat valve 23 and the B-natural valve 24 will be closed.

Figure 5:
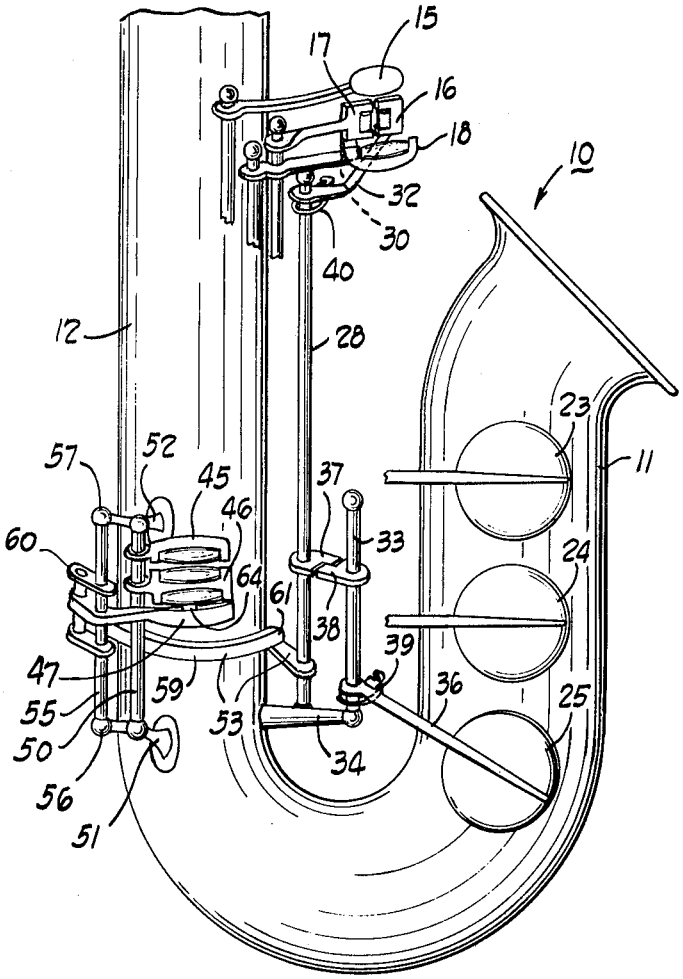
FIG. 5 is a simplified right side view of a saxophone, somewhat distorted, to better illustrate the invention.

The C-sharp key 16 is connected through linkage to actuate a C-sharp valve 25. This linkage may be anything suitable to provide a practical saxophone, and in the preferred embodiment, this is not a direct linkage but is an articulated linkage. This is perhaps best shown diagrammatically in FIG. 5, wherein the C-sharp key 16 is connected by a lever 32 underlying the B-flat key 18 to a C-sharp key shaft 28. A supplemental shaft 33 is secured to the saxophone as by a post 34 to be parallel to the C-sharp key shaft 28. The C-sharp valve 25 is connected by a lever 36 to the supplemental shaft 33 to rotate therewith. A first lever 37 is secured on the C-sharp key shaft 28 and cooperates with a second lever 38 secured on the supplemental shaft 33. At the supplemental shaft 33, a first spring 39, rather diagrammatically shown in FIG. 5, urges the C-sharp valve 25 toward an open position. A second spring 40, also diagrammatically shown in FIG. 5, at the C-sharp key shaft 28 urges the C-sharp key 16 to an extended position, and this spring 40 exerts more force than the spring 39 so that the key 16 is normally extended and the C-sharp valve 25 is normally closed. When the C-sharp key 16 is depressed against the urging of the second spring 40, the first spring 39 is permitted to open the C-sharp valve 25. A projection 42 secured to the B-natural valve 24 overlies the C-sharp valve 25, but spaced therefrom, when the valve 24 is open, so that when this B-natural valve 24 is closed, it also forces the C-sharp valve 25 closed.

A number of keys are provided for the right hand of the saxophone player, and in accordance with usual practice, two keys are provided for the little finger of the right hand. An E-flat key 45 may be depressed to actuate an E-flat valve 48 to produce the tone of E-flat. A C-natural key 46 may also actuate a C-natural valve 49 to produce the tone of C-natural. In this preferred embodiment, the E-flat key 45 and C-natural key 46 are separately journaled on a rotatable key shaft 50 for actuation of the E-flat valve 48 and C-natural valve 49, respectively. The key shaft 50 is journaled on a C post 51 and an E-flat post 52.

The invention includes a third key 47, which is a new key to actuate the C-sharp valve 25. Linkage 53 is provided between the new C-sharp key 47 and the C-sharp valve 25, and this linkage may take any of several practical forms. In the preferred embodiment, the new C-sharp key 47 is secured to a supplemental key shaft 55, which is journaled on posts 56 and 57, which have been silver-soldered to the C post 51 and the E-flat post 52, respectively. A lever 58 is secured to the supplemental key shaft 55 and extends from said key shaft on the side opposite the new C-sharp key 47. A link 59 has a first end pivoted to a first pivot 60 to the lever 58 to be moved with the lever 58. In the preferred embodiment, this link 59 is curved and is an arc of about 120 degrees around the body 12 of the saxophone 10. This permits the link to be unobstrusive and to perform its function without interference with other keys or valves. A second end of the link 59 is connected at a second pivot 61 to a lever 62 secured on the C-sharp key shaft 28. The remainder of the linkage 53 between the new C-sharp key 47 and the C-sharp valve 25 is merged with that previously described, namely, the first and second interengaging levers 37 and 38, the supplemental shaft 33, and the lever 36 to the C-sharp valve 25.

The newly added C-sharp key 47 enables the saxophone player to play the low register C-sharp with the right-hand little finger, relieving the left-hand little finger for use on the low B or B-flat keys 17 and 18. A tab 64 on the underside of the C-natural key 46 underlies the new C-sharp key 47, so that when this key 47 is depressed, it also actuates the C-natural key 46. Because of the projection 42 on the B-natural valve 24, the actuation of the B or B-flat keys 17 and 18 automatically cancels the C-sharp tone. The low register C-sharp tone may be produced by means of the conventional left-hand C-sharp key 16.

In the presently existing saxophones, in order to produce the C-sharp tone, it is necessary to depress the conventional left-hand C-sharp key 16 with the left-hand little finger and to simultaneously depress the C-natural key 46 with the right-hand little finger. The present invention also improves this fingering, because when the left-hand C-sharp key 16 is depressed, it automatically depresses the C-natural key 47 through the linkage 53 and the tab 64, therby relieving the right-hand little finger for smoothly facilitating the transition from C-sharp to E-flat. The result of the new key 47 and its interconnection allows certain difficult or impossible passages to be played with ease, such as a B to C-sharp trill, a B-flat to C-sharp tremolo, a C-sharp to E-flat trill, and a B-flat diminished arpeggio, to a low B-flat at a fast tempo. These passages are made possible because with the new C-sharp key 47, a B to C-sharp trill, for example, can be played by depressing the right hand C-sharp key 47 and moving only the left hand B key 17 to complete the trill, since the B key 17 automatically cancels the C-sharp, rather than trying to move the little finger of the left hand from side to side on the keys 16 and 17.

It will be noted that the new C-sharp key 47 and linkage 53 perform a dual function. The first function is that the low register C-sharp tone is permitted to be played by using the little finger of the right hand, as an alternative to using the little finger of the left hand; and it permits the playing of the C-sharp tone by utilizing the right-hand little finger rather than using both little fingers.

Figure 3:
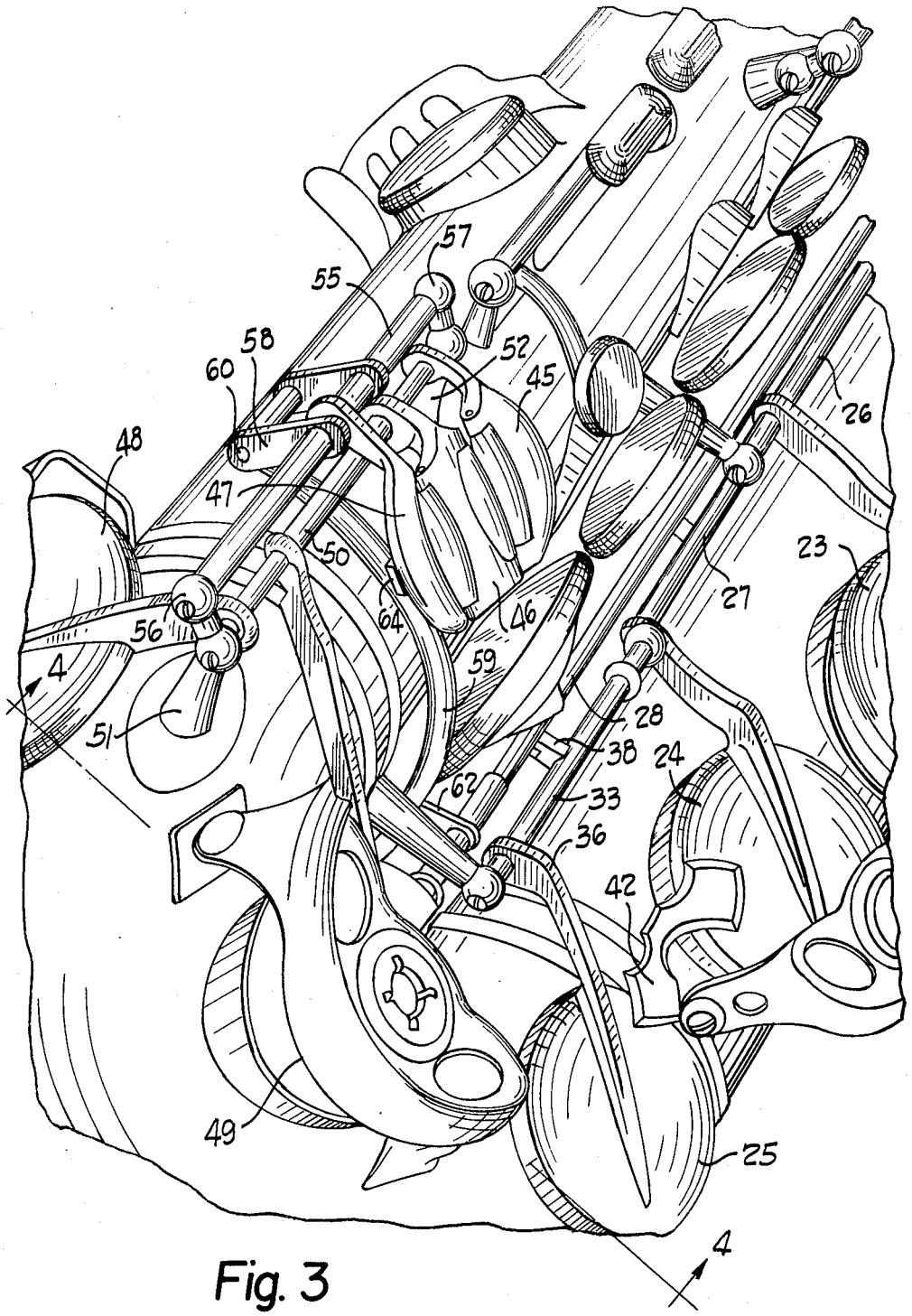
FIG. 3 is a perspective view of part of the right side of the saxophone incorporating the invention.
Figure 4:
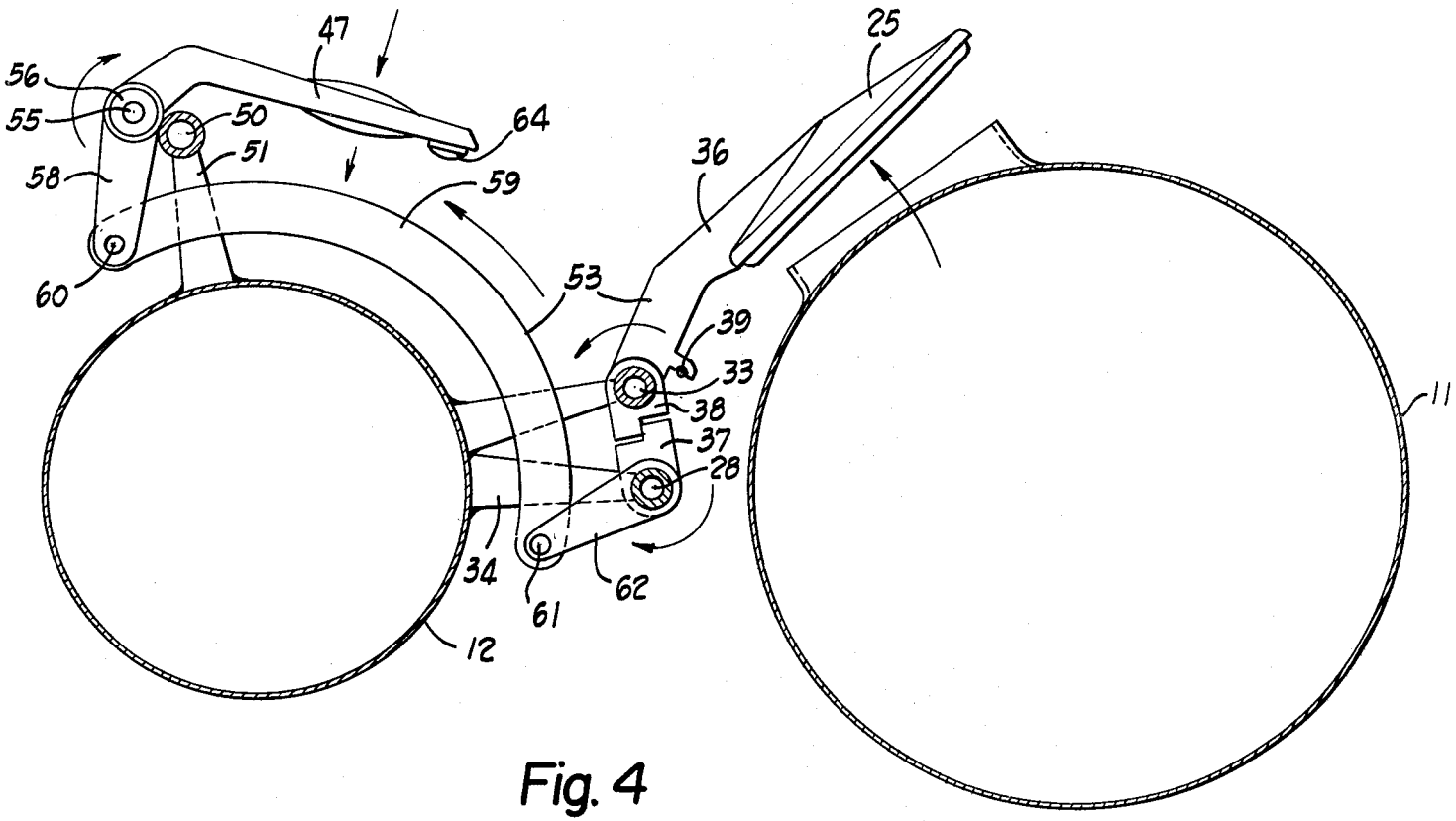
FIG. 4 is a simplified, sectional view, taken about on the line 4—4 of FIG. 3.

It will be noted that the link 59 is a rigid link, and is stressed in tension when the new key 47 is depressed, as shown in FIG. 4. This link is connected between a lever connected to the new C-sharp key 47 and a lever 62 connected to the conventional left-hand C-sharp key 18. As best shown in FIG. 3, the E-flat and C-natural keys 45 and 46, respectively, may be provided with rollers to aid the transition of actuation therebetween, and also the C-natural key 46 may be provided with a roller adjacent the new C-sharp key 47 to aid transition of actuation therebetween.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A saxophone having a body and a bell and a left-hand C-sharp key connected through a first linkage for actuating a low register C-sharp valve, comprising in combination:

a right-hand C-sharp key journaled for pivotal motions on said body;

a second linkage connecting said right-hand C-sharp key and the low register C-sharp valve; and said low register C-sharp valve being actuable alternatively through said first or second linkage by actuation of said left or right-hand low register C-sharp keys, respectively.

2. A saxophone as set forth in claim 1, wherein said second linkage merges with said first linkage for actuation of said C-sharp valve.

3. A saxophone as set forth in claim 1, wherein said second linkage includes a link extending around a portion of the periphery of said body.

4. A saxophone as set forth in claim 3, wherein said link extends between a lever moved by said additional key and a lever connected to said left-hand C-sharp key.

5. A saxophone as set forth in claim 1, wherein said second linkage includes an arcuate link stressable in tension.

6. In a saxophone, a new key for playing the C-sharp note in the lower register with the right hand, said key being located adjacent the lower end of the body of the saxophone whereby the low register C-sharp valve can be played with either the little finger of the left hand or the little finger of the right hand.

7. A new key as set forth in claim 6, wherein the saxophone includes a C-sharp key shaft, and linkage means linking said new key to said C-sharp key shaft as an additional means to actuate the low register C-sharp valve.

8. A new key as set forth in claim 6, wherein said linkage includes an arcuate link extending part way around the body of the saxophone.

9. A new key as set forth in claim 6, wherein the new key is pivoted on the lower portion of the body of the saxophone, and linkage is connected between the new key and the low register C-sharp valve.

10. A new key as set forth in claim 9, wherein said linkage includes an arcuate link extending part way around the body of the saxophone.

11. In a saxophone having a body, a bell, a left-hand C-sharp key connected through a first linkage for actuating a low register C-sharp valve and a right-hand low register C-natural key, the improvement comprising:

an additional key mounted for movement on the body; and a second linkage from said additional key to actuate both said low register C-sharp valve and the right-hand C-natural key.

12. The improvement as set forth in claim 11, wherein said additional key is positioned for actuation by the right hand of the player.

13. The improvement as set forth in claim 11, wherein said additional key is positioned adjacent said right-hand C-natural key, with a link therebetween.

14. The improvement as set forth in claim 13, wherein said link includes a tab connected to said C-natural key underlying said additional key.

* * * * *